US006457201B1

(12) United States Patent
Sham

(10) Patent No.: US 6,457,201 B1
(45) Date of Patent: Oct. 1, 2002

(54) TRAINING TOOTHBRUSH

(76) Inventor: Kwok-Kuen Sham, 88 Charlton Boulevard, Toronto, Ontario (CA), M2M 1B9

( * ) Notice: Subject to any disclaimer, the term of this patent is extended or adjusted under 35 U.S.C. 154(b) by 0 days.

(21) Appl. No.: 09/544,091

(22) Filed: Apr. 6, 2000

(51) Int. Cl.[7] ..... A46B 9/04
(52) U.S. Cl. ..... 15/167.1; 15/176.1
(58) Field of Search ..... 15/167.1, 176.1

(56) References Cited

U.S. PATENT DOCUMENTS 5,355,544 A * 10/1994 Dirksing 5,471,702 A * 12/1995 Schmitt

* cited by examiner

*Primary Examiner*—Randall E. Chin
(74) *Attorney, Agent, or Firm*—David W. Wong

(57) ABSTRACT

This toothbrush would operate normally only when the user brushes in a correct manner. It has a brush member slidably mounted to a handle. A latching arrangement is provided between the brush and the handle such that when the toothbrush is operated incorrectly in the direction along its longitudinal axis, the toothbrush would either slide freely in and out or completely detach from the handle rendering it inoperable. When brushing with the correct motion in the up and down direction perpendicular to its longitudinal axis, the latching arrangement would maintain the brush member securely mounted to the handle.

7 Claims, 4 Drawing Sheets

TRAINING TOOTHBRUSH

BACKGROUND OF THE INVENTION

This invention relates to toothbrushes and more particularly a toothbrush for training the user to brush with a correct technique.

It has been established in dental hygiene that tooth brushing should be carried out by brushing in the up and down direction perpendicular to the longitudinal axis of the toothbrush. Such correct brushing technique enables the toothbrush to clean the gaps between the teeth properly and thoroughly. More importantly, the gums are massaged with such action to pull towards the teeth so as to maintain them healthy and decease resistant. Gums diseases may cause many dental disorders.

In using a conventional toothbrush, the user tends to brush in the longitudinal direction of the toothbrush and transverse to the teeth, sideways from the left hand side to the right hand side or vice versa. Such sideways brushing action not only fails to clean the gaps between the teeth in which food particles are located, it also could cause damage to the gums. The decay of the food particles lodged in teeth gaps and crevices causes the breakdown of the teeth enamel to form cavities. Children particularly tend to brush in such incorrect manner.

Toothbrushes have been developed such as that shown in U.S. Pat. No. 5,673,451 to J. R. Moore et al, which emits a warning signal to the user when brushing in the incorrect manner. The construction of such toothbrushes is complex such that they are difficult and costly to produce. Moreover, the user may simply ignore the warning signal and continues to brush incorrectly. Therefore, such toothbrushes do not provide the intended purposes in practice, since they do not provide a positive means to prevent the user from brushing incorrectly.

SUMMARY OF THE INVENTION

It is a principal object of the present invention to provide a toothbrush which is operative only when the user brushes in a correct up and down manner.

It is another object of the present invention to provide a toothbrush which is simple in construction yet it operates effectively.

It is yet another object of the present invention to provide a toothbrush which has few component parts and is easy and inexpensive to produce.

The toothbrush comprises a handle having an elongated channel formed therein. The channel has a front opening. Two abutment members are formed at the front opening and extending towards one another. A brush member having an elongated body is slidably inserted into the channel of the channel. A latching means is provided at the end portion of the channel, and an associated latching means is formed at the end portion of the elongated body of the brush member. The latching means and the associated latching means are engageable with one another to secure the brush member mounted on the handle when the brush member is brushed in an up and down direction perpendicular to the longitudinal axis of the brush member. The latching means and the associated latching means will disengage with one another when the brush member is brushed in a direction along the longitudinal axis of the brush member.

BRIEF DESCRIPTION OF THE DRAWINGS

Other objects and advantages of the present invention will become apparent from the following detailed description of the preferred embodiments thereof in connection with the accompanying drawings in which.

DETAILED DESCRIPTION OF THE PREFERRED EMBODIMENTS

Figure 1:
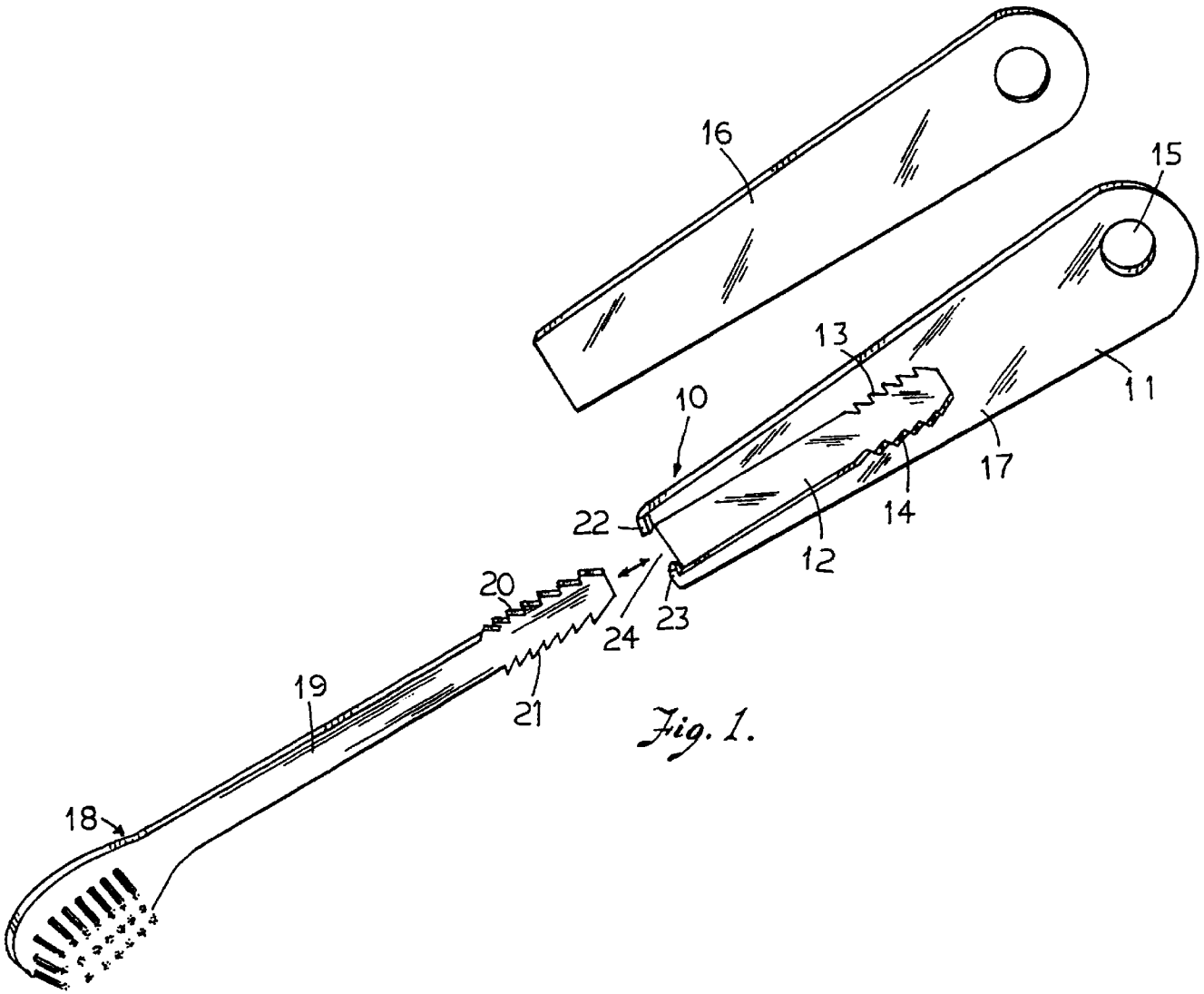
FIG. 1 is an exploded perspective elevation view of the basic embodiment of the toothbrush according to the present invention.

With reference to the drawings wherein like reference numerals designate corresponding parts in the several views, the toothbrush 10 of the present invention has a handle 11 with an elongated channel 12 formed therein. The elongated channel 12 is opened at the front end of the handle, and a plurality of teeth 13 and 14 are formed on the two side walls respectively of the end portion of the channel 12. A convenience opening 15 is provided adjacent to the rear end of the handle 11. The convenience opening 15 is operative for hanging the toothbrush. A cover plate 16 shaped as the handle 11 may be placed over the top surface 17 of the handle and it may be secured in place, for example, by adhesive or ultrasonic sealing. A brush member 18 having an elongated body 19 is slidably attachable to the handle 11 by inserting into the channel 12. The width of the elongated body 19 of the brush member 18 is slightly smaller than the width of the channel 12. A plurality of teeth 20 and 21 are respectively formed on the two sides of the end portion of the elongated body 19. The teeth 20 and 21 are complementary to the teeth 13 and 14 formed on the side walls at the bottom portion of the channel 12, and they normally do not engage with one another when the elongated body 19 is located parallel to the side walls of the channel 12 such that the elongated body 19 of the brush member 18 may slide freely within the channel. Two abutment members 22 and 23 are provided at the two sides of the front opening 24 18 of the channel 12. The two abutment members 22 and 23 extends towards one another to reduce the size of the front opening 24 such that after the brush member 18 has been slidably mounted to the handle 11, it is difficult to remove the brush member 18 from the handle. Also, the width of the end portion of the body portion 19 having the teeth 20 and 21 may be slightly wider such that the brush member 18 can slide in the direction of the longitudinal axis of the handle 11 but it can not be detached from the latter. The teeth 13 and 14 on the side walls of the channel 12 preferably have a side perpendicular to the longitudinal axis of the elongated body 19, similarly the teeth 20 and 21 on the side walls at the end portion of the elongated body 19 preferably also have a side perpendicular to the longitudinal axis of the elongated body 19.

Figure 2:
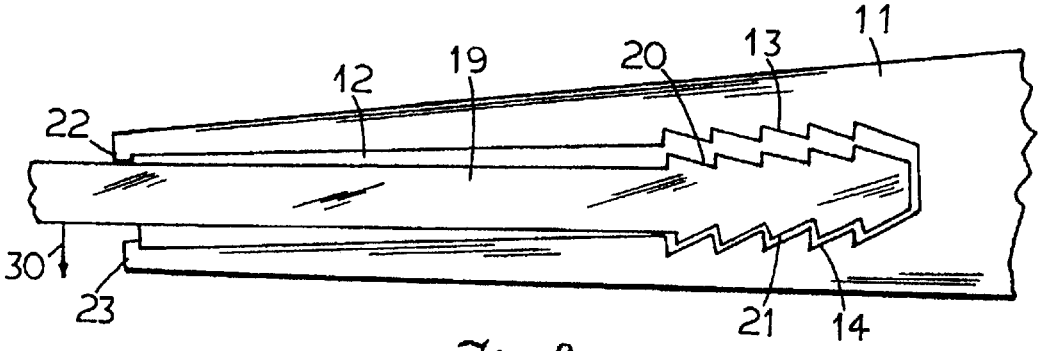
FIG. 2 is an isolated enlarged top elevation view showing the latching arrangement when the toothbrush is correctly brushed with a downward motion.
Figure 3:
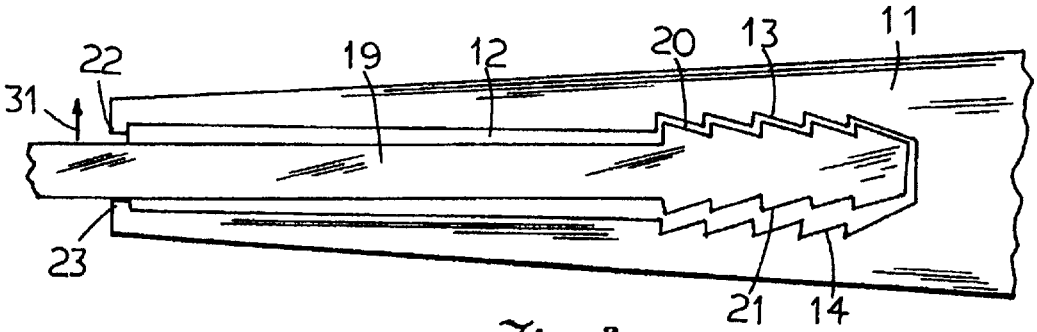
FIG. 3 is an isolated enlarged top elevation view showing the latching arrangement when the toothbrush is operated correctly with an upward motion.
Figure 4:
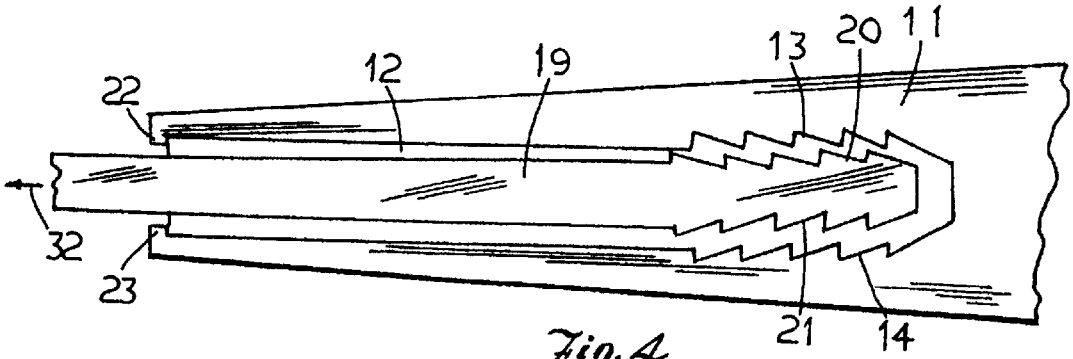
FIG. 4 is an isolated enlarged top elevation view showing the disengagement of the latching arrangement when it is brushed incorrectly in the direction along its longitudinal axis.

In use, when the brush member 18 is brushed in a downward direction 30 as best shown in FIG. 2, the friction between the brush member 18 and the teeth of the user will cause the front part of the elongated body 19 to butt against the abutment member 22 which serves as a fulcrum such that a pivoting action is exerted on the elongated body 19 to cause the teeth 21 at its end portion to engage with the teeth 14 on the side wall of the channel 12. In this manner, the brush member 18 is latched securely in place to facilitate the downward brushing movement of the brush member 18. Similarly, when the brush member 18 is brushed in an upward direction 31 as shown in FIG. 3, the front portion of the elongated body 19 will butt against the abutment member 23 16 which serves as a fulcrum to cause the teeth 20 at the end portion of the elongated body 19 to engage with the teeth 13 on the side wall of the channel 11. Thus, the engagement of teeth 20 and 13 will also maintain the brush 18 to be latched in place to facilitate the upward brushing movement of the brush member 18. The perpendicular sides of the teeth 13 and 14 engage with the perpendicular sides of teeth 20 and 21 respectively to provide a positive latching engagement. When the brush member 18 is brushed incorrectly with the motion in the direction 32 along its longitudinal axis as shown in FIG. 4, no pivoting action is exerted on the elongated body 19 such that the teeth 20 and 21 will not engage with the teeth 13 and 14, resulting in that the friction between the user's teeth and the brush member 18 would pull the brush member 18 to slide freely in the in and out direction along its longitudinal direction relative to the handle 11 making it impossible to carry out the brushing operation in this manner.

In order to ensure that the brush member 18 can not be detached completely from the handle 11, an elongated slot 34 is formed in the elongated body 19 of the brush member 18. The elongated slot 34 is slidably engaged with a stop projection 35 integrally formed on the base of the channel 12 such that the brush member 18 may slide in an in and out direction relative to the handle 11 but it can not be detached completely therefrom. Thus, the user may not remove the brush member 18 from the handle 12 to brush with the brush member per se without the handle.

Figure 5:
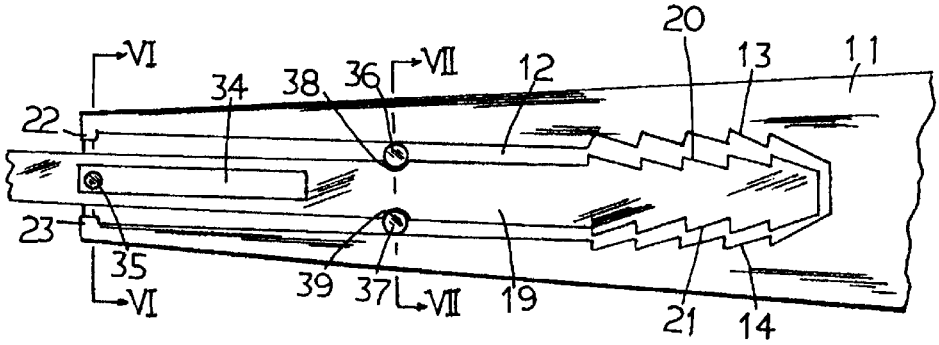
FIG. 5 is an isolated enlarged top elevation view showing an alternative embodiment of the toothbrush according to the present invention.
Figure 6:
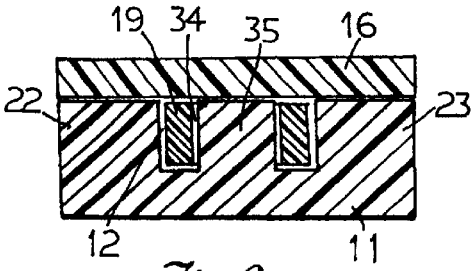
FIG. 6 is an enlarged sectional front view along section line VI—VI of FIG. 5.
Figure 7:
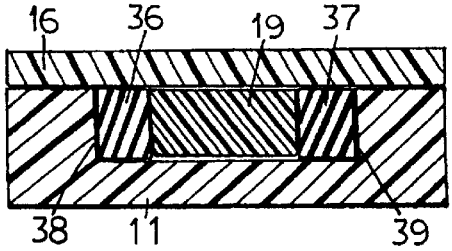
FIG. 7 is an enlarged sectional front view along section line VII—VII of FIG. 5.
Figure 9:
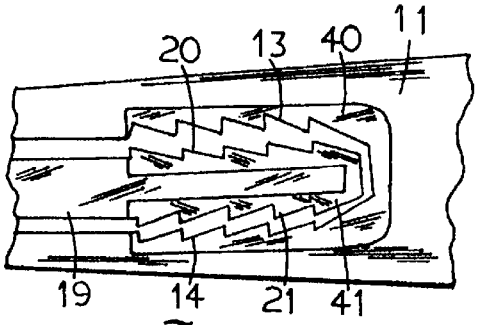
FIG. 9 is an enlarged isolated top elevation view showing another alternative construction of the teeth insert of the latching arrangement.
Figure 8:
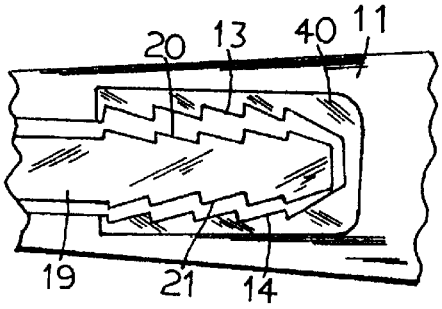
FIG. 8 is an enlarged isolated top elevation view showing the teeth insert of the latching arrangement.

Two cylindrical soft rubber spacers 36 and 37 may be located between the elongated body 19 and the side walls of the channel 12 in order to maintain the spacing between the elongated body 19 and the side walls so as to provide a smooth sliding movement of the brush member 18 relative to the handle 12 as well as ensuring the latching teeth 13 and 14 normally do not engage with the teeth 20 and 21. Two semi-circular depressions 38 and 39 may be either formed at the elongated body 19 or the side walls of the channel 12 to retain the spacers 36 and 37 in place. FIG. 5 shows the example in which the depressions 38 and 39 are formed on the elongated body 19.

To facilitate ease of manufacturing, the teeth 13 and 14 may be formed on a separate U-shaped insert 40 which can be mounted within a similarly sized rectangular portion formed in the end portion of the channel 12. Similarly, the teeth 20 and 21 may be formed on an attachment member 41 mounted to the end portion of the elongated body 19. Furthermore, it can be appreciated by those skilled in the art that the insert 40 and the attachment 41 may be made of a material having a high surface friction without the formation of teeth thereon. Such toothless insert and attachment member will engage with each other to provide a latch-like action to maintain the brush 18 attaching to the handle in the same manner as described above.

Figure 10:
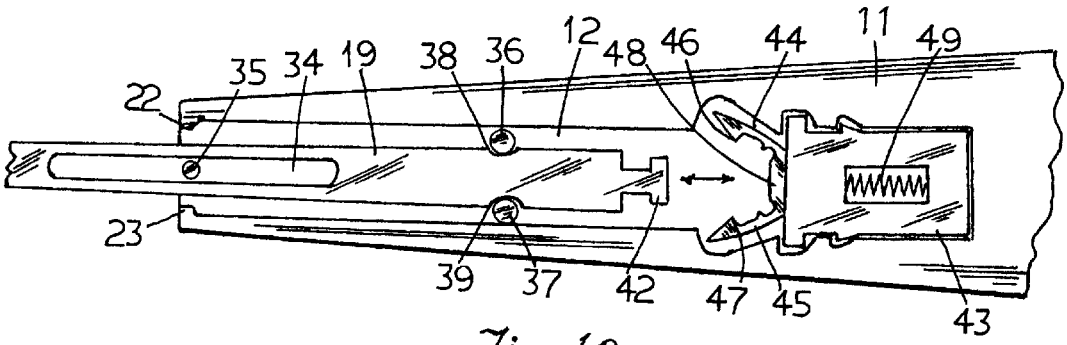
FIG. 10 is an enlarged isolated top elevation view showing an alternative embodiment of the latching arrangement for the toothbrush.
Figure 11:
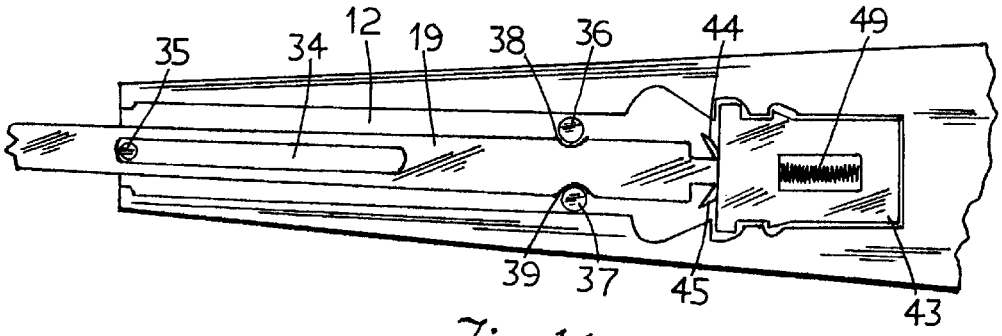
FIG. 11 another enlarged isolated top elevation view of FIG. 10 with the brush member secured firmly to the latching arrangement.

An alternative embodiment of the present invention is best shown in FIGS. 10 and 11. In this embodiment, a T-shaped end 42 is formed at the elongated body 19, and a double action spring latch 43 is mounted at the end portion of the channel 12. The double action spring latch 43 has a V-shaped jaw consisting of two pivotal fingers 44 and 45 having inwardly extending ridges 46 and 47 formed in their inner surface. The fingers 44 and 45 are pivotable relative to a base member 48 which is biassed by a spring 49. The fingers 44 and 45 will be held in a close position when the base member 48 is pushed against the spring 49 to retract into the housing of the spring latch 43 and it will be locked in this retracted position in which the fingers 44 and 45 will close against one another. The spring latch 43 in the retracted position will return to the upper position by the biassing force of the spring 49 when the base member 48 is pushed a second time. In this upper position the pivotal fingers 44 and 45 will return to the open position. In use, the brush member 18 is slidably inserted inwards to push the base member 48 of the spring latch 43 to the retracted position such that the fingers 44 and 45 will close and capture the T-shaped end of the brush member 18 to retain the latter in place. When the brush member 18 is brushed in the correct up and down movement, no force is exerted upon the base member 48, thus the brush member 18 is securely mounted to the handle 11 for carrying the correct up and down brushing operation. When the brush member 18 is operated in the incorrect direction along its longitudinal axis, the longitudinal force will exert a pushing force on the base member 48 so that it will return from the retracted position to the upper position resulting the fingers 44 and 45 returning to the open position and releasing their grip on the T-shaped end 42 of the brush member 18; thus the brush member will slide freely relative to the handle in the in and out direction making the brushing operation inoperative.

While the present invention has been shown and described in the preferred embodiments thereof, it will be apparent that various modifications can be made therein without departing from the spirit or essential attributes thereof, and it is desired therefore that only such limitations be placed thereon as are imposed by the appended claim.

What I claim is:

1. A toothbrush comprising, a handle member having an elongated channel formed therein, said channel having a front opening, two abutment members formed at said front opening, and extending towards one another, a brush member having an elongated body slidably inserted into said channel of said handle member, a latching means provided at an end portion of said channel, an associated latching means formed at an end portion of said elongated body, said latching means and said associated latching means being engageable with one another to secure said brush member mounted on said handle member when said brush member is brushed in an up and down direction perpendicular to the longitudinal axis of said brush member, and said latching means and associated latching means being disengaged with one another when said brush member is brushed in a direction along the longitudinal axis of said brush member.

2. A toothbrush according to claim 1 including a cover shaped and sized as said handle member and adapted to cover over said handle member.

3. A toothbrush according to claim 2 wherein said latching means and said associated latching means are made of a material having a high surface friction.

4. A toothbrush according to claim 2 wherein said latching means is a plurality of teeth formed on two side walls of a rear end portion of said channel, and said associated latching means is a plurality of associated teeth formed on two opposite side walls on an end portion of said elongated body of said brush member.

5. A toothbrush according to claim 4 wherein said plurality of teeth and associated teeth have a side extending perpendicular to the longitudinal axis of said elongated body.

6. A toothbrush according to claim 5 including an elongated slot formed in said elongated body, a projection member formed in said channel, said elongated slot being slidably engageable with said projection member whereby said brush member is not removable from said handle member.

7. A toothbrush according to claim 6 including two cylindrical spacers located between said channel and adapted to maintain said elongated body normally spaced from side walls of said channel.

* * * * *